US007841283B2

(12) United States Patent
Kawaguchi et al.

(10) Patent No.: US 7,841,283 B2
(45) Date of Patent: Nov. 30, 2010

(54) SEWING MACHINE

(75) Inventors: Yasuhiko Kawaguchi, Nagoya (JP); Yasukazu Noguchi, Nagoya (JP); Noriko Kawabe, Neyagawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 938 days.

(21) Appl. No.: 11/714,100

(22) Filed: Mar. 6, 2007

(65) Prior Publication Data

US 2007/0209564 A1 Sep. 13, 2007

(30) Foreign Application Priority Data

Mar. 7, 2006 (JP) ..... 2006-060804

(51) Int. Cl.
*D05B 47/04* (2006.01)
*B65H 59/00* (2006.01)

(52) U.S. Cl. ..... 112/221; 112/302; 112/254; 242/147 R

(58) Field of Classification Search ..... 112/221, 112/302, 254, 255, 242, 243, 246, 247, 163, 112/2, 225; 242/147 R, 150 R; 267/158
See application file for complete search history.

(56) References Cited

U.S. PATENT DOCUMENTS 2,518,703 A * 8/1950 Marsac ..... 242/150 R
4,736,698 A * 4/1988 Inagaki ..... 112/247
4,934,291 A * 6/1990 Yamamoto ..... 112/163
5,003,900 A * 4/1991 Ogawa ..... 112/242
5,020,462 A * 6/1991 Sato et al. ..... 112/302
6,941,881 B2 9/2005 Noguchi et al.
7,082,886 B2 8/2006 Noguchi et al.
2007/0044698 A1* 3/2007 Fujihara ..... 112/302
2007/0193484 A1* 8/2007 Rodrigues ..... 112/2

FOREIGN PATENT DOCUMENTS

JP A 2004-222916 8/2004

* cited by examiner

*Primary Examiner*—Ismael Izaguirre
(74) *Attorney, Agent, or Firm*—Oliff & Berridge, PLC

(57) ABSTRACT

In the disclosed sewing machine, when a needle threading switch is operated when sewing operation is stopped, a needle bar drive mechanism is activated, a needle threading hook is moved forward to a threading position, and a thread take-up is lowered by predetermined distance by driving a sewing machine motor in reverse rotation after threading a hook portion with a needle thread. Thus, a thread engaging portion of a check spring absorbs loss of required thread amount at the thread take-up and moves from a spring force operable position to a spring force inoperable position. Thus, the needle threading hook retracts to a loop cancel position and the needle thread reliably threads the sewing needle with secure engagement with the needle threading hook when a needle thread end is pulled off from a first thread retaining portion since needle thread is stabilized by absence of needle thread tension.

5 Claims, 14 Drawing Sheets

SEWING MACHINE

This application is based upon and claims the benefit of priority from the prior Japanese Patent Application 2006-060804, filed on, Mar. 7, 2006 the entire contents of which are incorporated herein by reference.

FIELD

The present disclosure is directed to a sewing machine that automatically threads an eye of a sewing needle with a needle thread guided by a threading route by using a threading hook of a threading mechanism at the time of sewing start and thread replacement.

BACKGROUND

Various types of sewing machines provided with a needle threading mechanism capable of automatically threading an eye of the sewing needle have been conventionally suggested. For example, a sewing machine disclosed in JP 2004-222916 A (hereinafter referred to as patent document 1) is provided with a thread drawing mechanism including a drive motor, a sector gear, and a thread drawing member; and a needle threading mechanism including a needle threading motor and a needle threading hook. In such sewing machine, first, the needle thread is manually threaded on a hook portion of a needle threading hook which has passed through the eye of the sewing needle when the needle threading hook is driven into a threading position from a stand-by position. Then, when the needle threading hook is retracted to a loop cancel position, the thread drawing member is driven into the thread drawing position from the stand-by position to be engaged with the thread end side of the needle thread. Thereafter, the thread drawing member returns to the stand-by position and the needle thread end is retained by a first thread retaining portion.

In the sewing machine described in patent document 1, the needle threading hook is threaded as follows. The needle thread drawn from the thread spool is manually engaged with the hook portion of the needle threading hook after being threaded to a thread engagement portion of a check spring and the thread-take up; and thereafter, the needle thread end is retained by the second thread retaining member provided in a needle bar case. At this time, thread tension is exerted on the needle thread depending upon the manner of threading operation and the thread engagement portion of the check spring may be rotated to a spring force operating position by the thread tension.

When the needle threading hook is retracted from the threading position in which the needle thread is threaded thereto to the loop cancel position in which the needle threading hook comes out of the eye of the sewing needle, the needle thread end is gradually pulled out of the second thread retaining portion. When the needle thread end is completely pulled out of the second thread retaining portion, needle thread tension is cancelled so that the engagement portion of the check spring is rotated to an inoperable position by the spring force. At this time, the needle thread in the thread end side is loosened by the cancellation of the needle thread tension and at the same time is pulled at once toward the check spring by the returning force of the check spring, thereby exhibiting instability in operation, leading to needle threading failures where the needle thread is removed from the needle threading hook.

SUMMARY

An object of the present disclosure is to provide a sewing machine capable of retaining a secure engagement of the needle thread to the needle threading hook from the moment when the needle threading hook is moved forward to be engaged with the needle thread until being retracted to complete the needle threading operation, so as to reliably prevent needle threading failures.

The sewing machine of the present disclosure includes a thread take-up; a needle bar having a sewing needle attached thereto; a check spring provided in a threading route of a needle thread and being engaged with a needle thread directed toward the thread take-up; a needle threading mechanism having a needle threading hook for threading an eye of the sewing needle; a needle threading mechanism drive unit for driving the needle threading mechanism; a sewing machine motor driving the thread take-up and the needle bar; and a control unit for controlling the sewing machine motor; and the control unit controls the thread take-up so as to be lowered by a predetermined distance so that spring force of the check spring is not operated on the needle thread when the needle threading mechanism is driven by the needle threading mechanism drive unit to thread the eye of the sewing needle.

According to the sewing machine of the above configuration, the control unit controls the sewing machine motor so as to lower the thread take-up by the predetermined distance so that the spring force of the check spring is not operated on the needle thread when the needle threading mechanism is driven by the needle threading mechanism drive unit to thread the eye of the sewing needle. Thus, no thread tension is exerted on the needle thread even in case the needle thread-end is pulled off of the thread retaining portion when the needle threading hook comes out of the eye after passing through the eye and engaging with the needle thread. As a result, the needle thread is stabilized and is no longer removed from the needle threading hook, thereby reliably preventing the occurrence of needle threading errors.

BRIEF DESCRIPTION OF THE DRAWINGS

Other objects, features and advantages of the present disclosure will become clear upon reviewing the following description of the illustrative aspects with reference to the accompanying drawings, in which, FIG. 1 indicates a first illustrative aspect of the present disclosure showing a perspective view of a multi-needle embroidery sewing machine.

DETAILED DESCRIPTION

Figure 1:
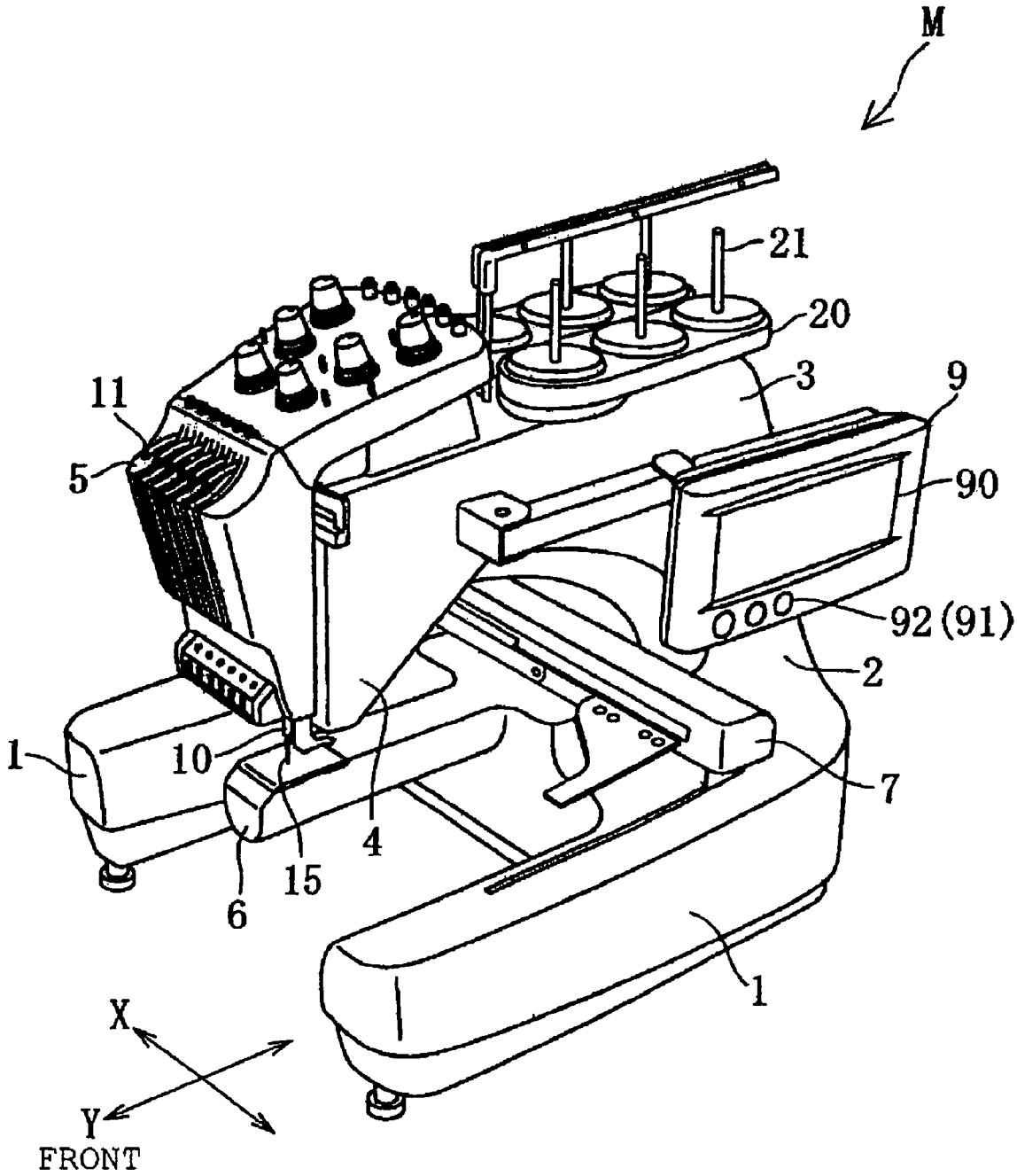

Referring to FIG. 1, a multi-needle embroidery sewing machine M includes a pair of left and right support legs 1; a pillar 2 standing on the rear end of the support leg 1; and an arm 3 forwardly extending from the upper end of the pillar 2. Provided in a head 4 constituting the distal end of the arm 3 is a needle bar case 5 disposed laterally movably. Also, the multi-needle embroidery sewing machine M includes a cylinder bed 6 forwardly extending from the lower end of the pillar 2; a frame moving mechanism (not shown) moving an embroidery frame not shown in an X-direction and a Y-direction perpendicular to the X-direction via a carriage 7; and an operation panel 9 provided in the arm 3. A description will not be given on the frame moving mechanism.

Figure 3:
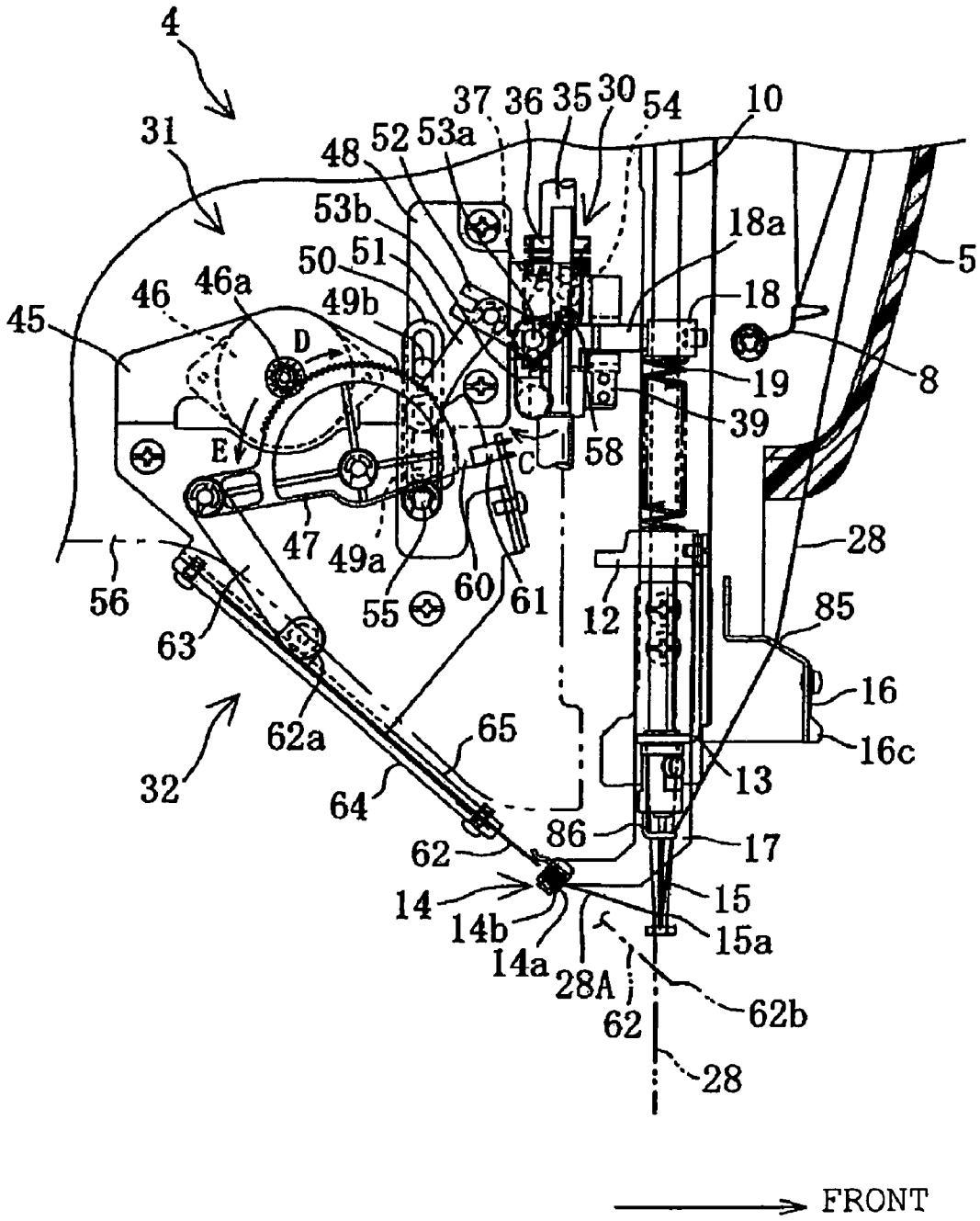
FIG. 3 is a partial left side view showing a vertical cross-section of a main portion of the multi-needle embroidery sewing machine.
Figure 4:
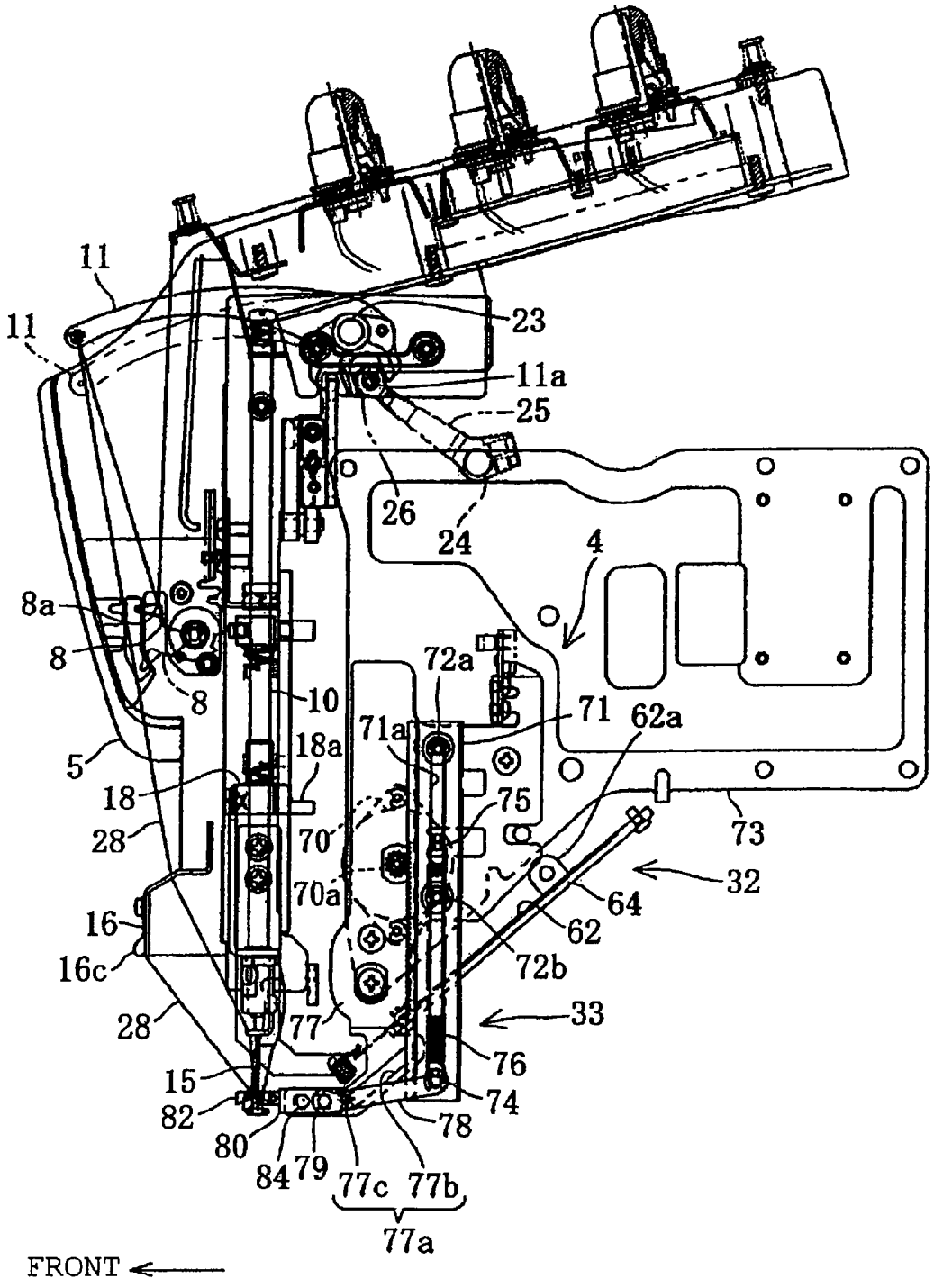
FIG. 4 is a right side view of a vertical cross-section showing a main portion of the multi-needle embroidery sewing machine.

Referring to FIGS. 3 and 4, the head 4 includes a needle bar case 5, a needle bar drive mechanism 30, a needle bar release mechanism 31, a thread drawing mechanism 32 including a thread drawing member 62, and a needle threading mechanism 33. The needle bar drive mechanism 30 selectively transmits a vertically oriented drive force to one of a plurality (six) of needle bars 10 provided in the needle bar case 5. The needle bar release mechanism 31 controls intermittence of drive force transmitted from the needle bar drive mechanism 30 to the needle bar 10. The needle threading mechanism 33 is provided with a needle threading hook 83 passing the needle thread through the eye 15a of the sewing needle 15.

Figure 2:
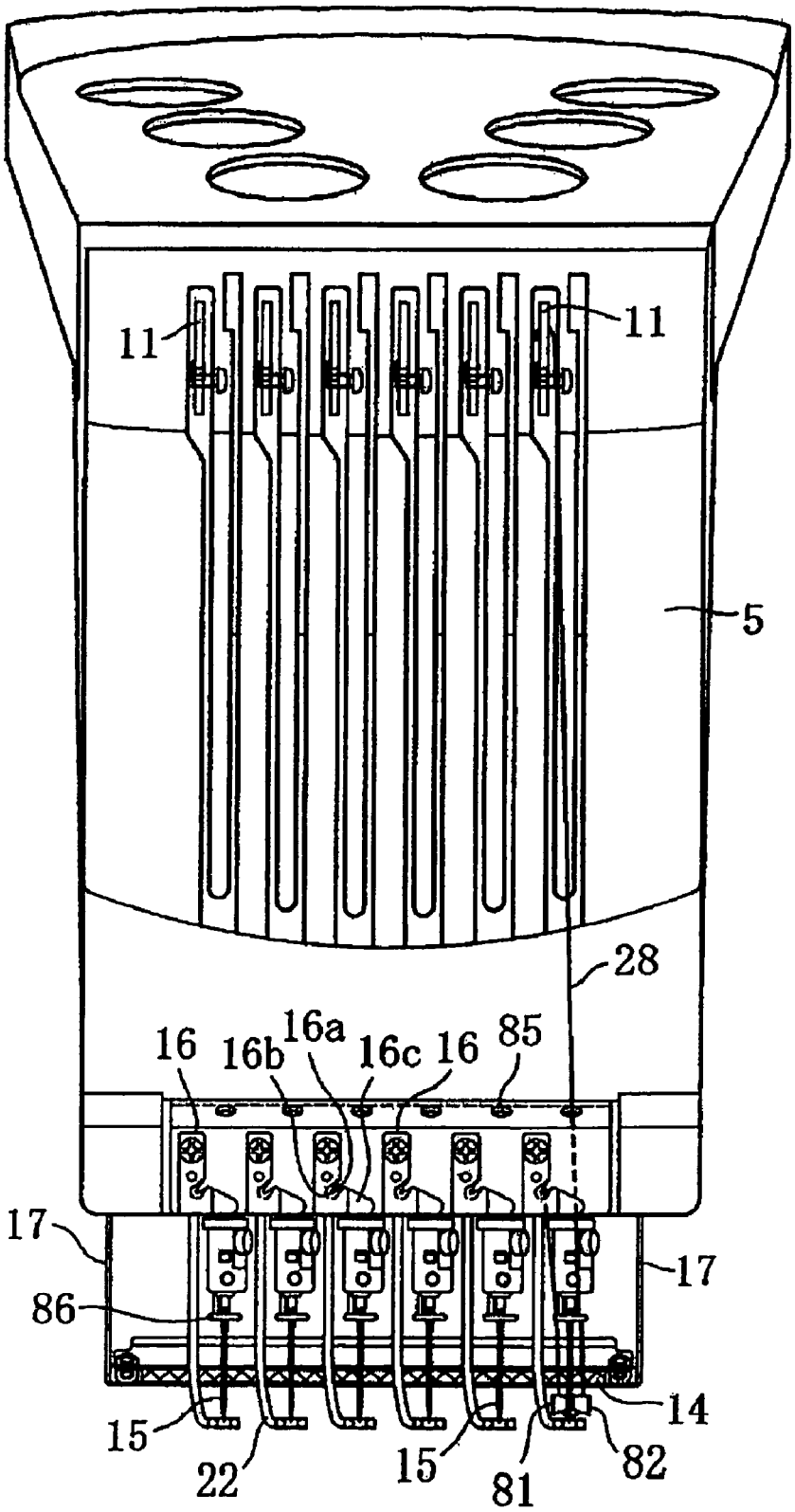
FIG. 2 is a front view of a needle bar case.

Referring to FIGS. 2 to 4, the needle bar case 5 includes six needle bars 10 extending in the vertical direction; six thread take-ups 11; a needle bar guide member 12 and a second needle bar guide member 13; a first thread retaining member 14; a second thread retaining member 16; and a presser foot 22. Each of the six thread take-ups 11 are respectively attached swingably at positions corresponding to the six needle bars 10. The first needle bar guide 12 and the second needle bar guide 13 guide the needle bar 10 by being secured to the needle bar case 5. The first thread retaining member 14 is disposed in the lateral direction and is supported at both ends thereof by a securing plate 17 secured to the needle bar case 5. The second thread retaining member 16 is provided so as to be associated with each sewing needle 15 attached to the lower end of the needle bars 10.

Secured at the height directional mid-portion of the needle bar 10, is a connecting member 18 having a connecting pin 18a to which the drive force of the needle bar drive mechanism 30 is transmitted. A compression coil spring 19 upwardly biasing the needle bar 10 is fitted on a portion of the needle bar 10 situated between the connecting member 18 and the first needle bar guide member 12. The sewing needle 15 is attached to the lower end of each needle bar 10 respectively, and a needle thread 28 for embroidery-use is supplied to each of the six sewing needles 15 respectively from the thread spool (not shown) set to each spool pin 21 standing on the thread base 20.

The first thread retaining member 14 is for holding the end of the needle thread 28 wiped by the thread drawing mechanism 32, and is provided with a hook-shaped thread-retaining tape 14*a* and a reinforcing plate 14*b* that clamps the thread retaining tape 14*a*.

The second thread retaining member 16 is for tentatively holding the end of the needle thread 28 manually hooked on the needle threading hook 83 before passing the needle thread 28 through the eye 15*a* of the sewing needle 15 upon execution of needle threading operation by the needle threading mechanism 33. The second thread retaining member 16 includes a retaining portion 16*b* for retaining the end of the needle thread 28 cut by the blade 16*a*; and a guide portion 16*c* having a forwardly projecting distal end and guiding the needle thread 28 to the retaining portion 16*b*.

Under such configuration, the needle thread 28 is passed behind the guide portion 16*c* from the right side to the left side and thereafter pulled forwardly downward to be cut by the blade 16*a*. At this time, the needle thread 28 end is retained by the retaining portion 16*b* and the front face of the needle bar case 5.

Figure 12:
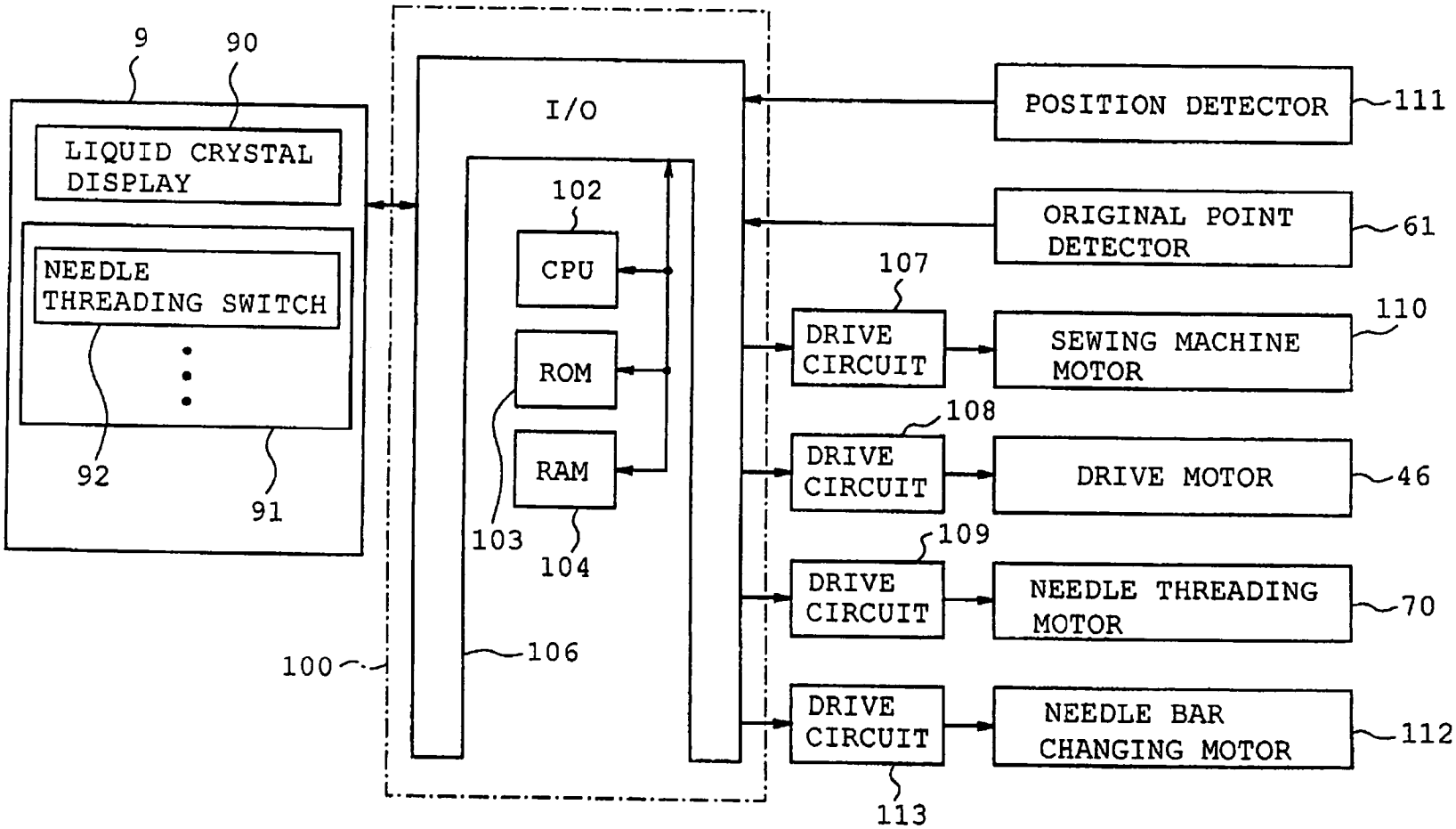
FIG. 12 is a block diagram of a control system of the multi-needle embroidery sewing machine.

Also, one of the sewing needles 15 is switched to the sewing position confronting a needle hole (not shown) defined at the distal end of the cylinder bed 6 by the needle bar case 5 being laterally moved by the needle bar changing motor 112 (refer to FIG. 12). When drive force of the sewing machine motor 110 is transmitted to the needle bar drive mechanism 30 via the sewing machine main shaft, with the sewing needle 15 switched to the sewing position, the selected needle bar 10 is vertically driven by the vertical drive of the needle bar drive mechanism 30 and stitches are formed on the workpiece cloth by cooperation of the sewing needle 15 and the rotating shuttle (not shown).

Referring to FIG. 4, the thread take-up 11 is supported vertically swingably by the support shaft 23. On the other hand, a thread take-up swing lever 25 is secured to a thread take-up swing shaft 24 reciprocably swung by the rotation of the sewing machine main shaft, and a roller member 26 supported by the distal end of the thread take-up swing lever 25 is engaged with a bifurcated portion 11*a* of the thread take-up 11. Thus, upon execution of a sewing operation, since the sewing machine main shaft is rotated by the drive of the sewing machine motor 110, the thread take-up 11 is vertically reciprocably driven via the swing of the thread take-up swing shaft 24 and the thread take-up swing lever 25.

Next, a description will be given on the needle bar drive mechanism 30.

Figure 5:
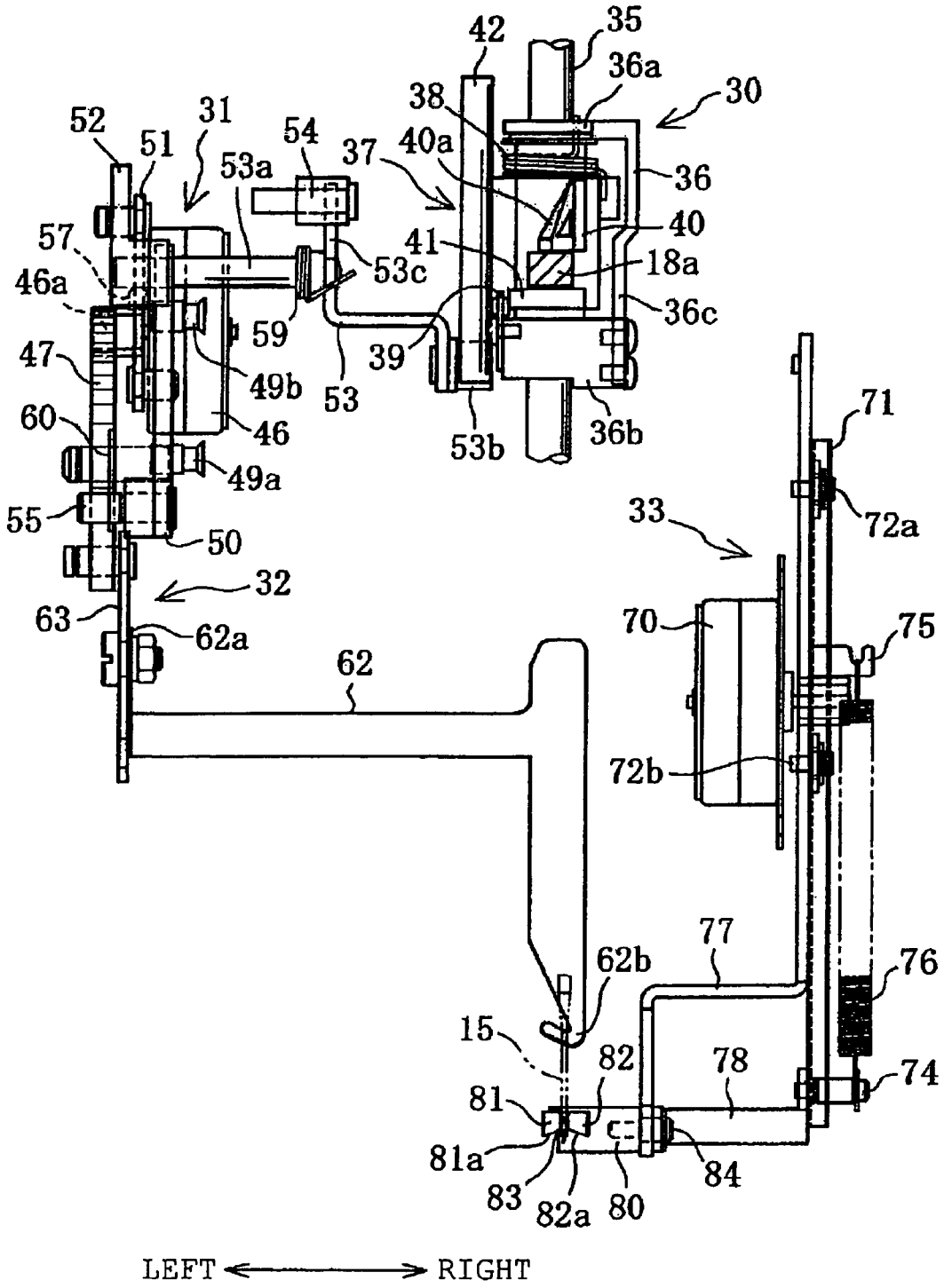
FIG. 5 is a front view of a needle bar drive mechanism, a needle bar release mechanism, a thread drawing mechanism, and a needle threading mechanism.
Figure 6:
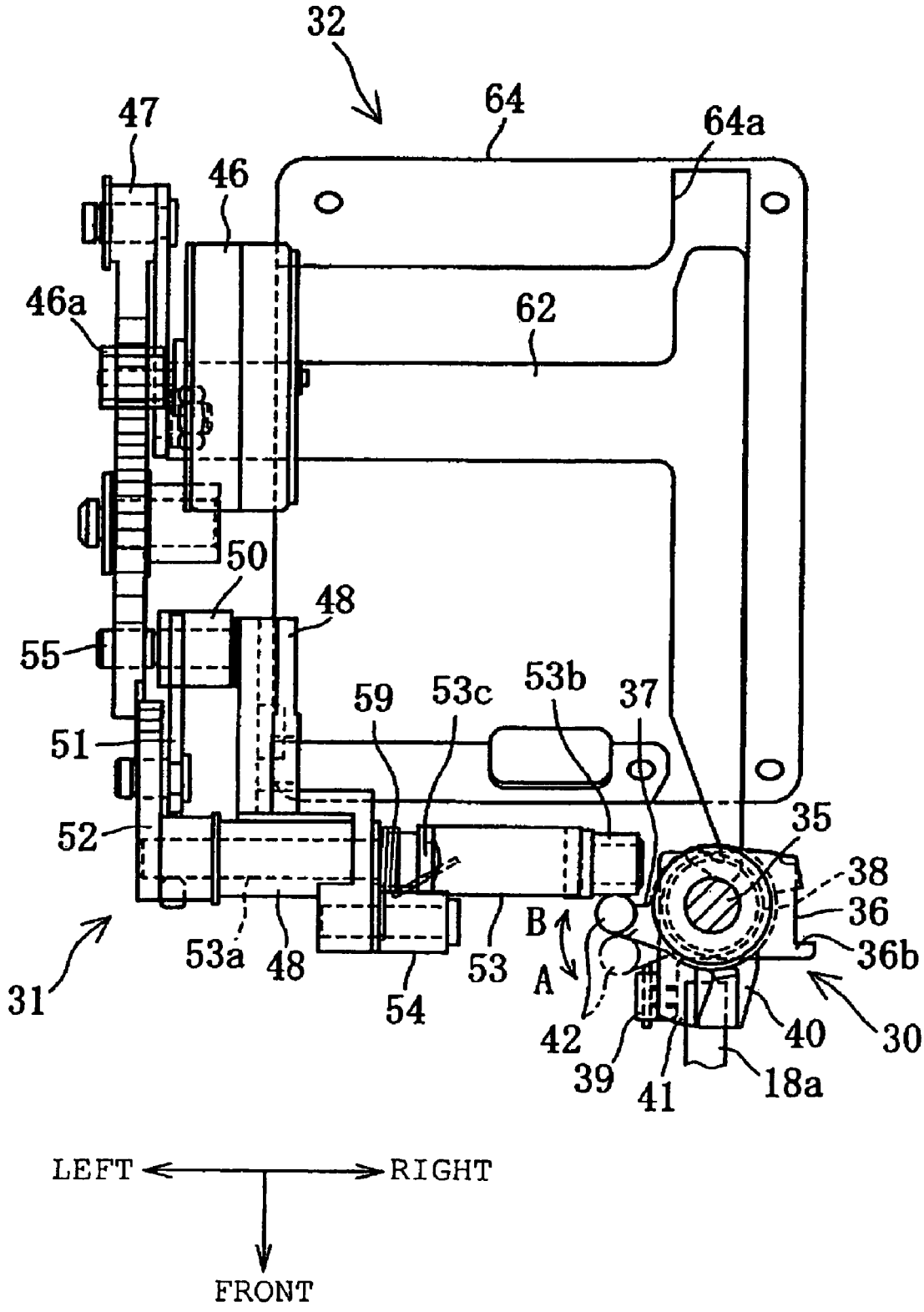
FIG. 6 is a plan view of a needle bar drive mechanism, a needle bar release mechanism, and a thread drawing mechanism.

Referring to FIGS. 3, 5, and 6, the needle bar drive mechanism 30 includes a base needle bar 35, a drive member 36, a transmitting member 37, and a first torsion spring 38. The base needle bar 35 is disposed parallel to the needle bar 10. The drive member 36is supported slidably and unrotatably by the base needle bar 35. The transmitting member 37 can be driven vertically with the drive member 36 and is supported rotatably by the base needle bar 35. The first torsion spring 38 has one end thereof in abutment with the drive member 36 and the other end in abutment with the transmitting member 37. The first torsion spring 38 bias the transmitting member 37 to the transmitting position that allows transmission of drive force to the needle bar 10.

The drive member 36 includes an upper drive member 36*a* and a lower drive member 36*b* fitted on the base needle bar 35 and a connecting portion 36*c* connecting the upper and lower drive members 36*a* and 36*c*. The first torsion spring 38 is fitted on the upper drive member 36*a* and a stopper 39 for restricting rotation of the transmitting member 37 at a predetermined angle is secured on the left side face of the lower drive member 36*b*.

The transmitting member 37 is attached between the upper drive member 36*a* and the lower drive member 36*b*. The transmitting member 37 includes a first engagement member 40 and a second engagement member 41 for engagement of the connection pin 18*a*, and an abutment pillar 42 to which rotational drive force for releasing the needle bar 10 by the needle bar release mechanism 31 is transmitted. The first engagement member 40 has a sloped portion 40*a* for rotating the transmitting member 37 in a direction indicated by arrow A in FIG. 6 when the released connection pin 18*a* is placed in abutment therewith.

Next, a description will be given on the needle bar release mechanism 31.

The needle bar release mechanism 31 includes a drive motor 46 composed of a pulse motor attached to a securing member 45; a sector gear 47 in mesh engagement with a drive gear 46*a* secured to an output shaft of the drive motor 46; a guide subject plate 50; a first link member 51; a second link member 52; an abutting member 53; and a stopper 54. The guide subject plate 50 is attached vertically movably by guidance of guide pins 49*a* and 49*b* secured to the securing member 48. The first link member 51 has the lower end thereof swingably connected to the central portion of the guide subject plate 50. The second link member 52 is swingably connected to the upper end of the first link member 51. The abutting member 53 swings along with the second link member 52. The stopper 54 is secured to the securing member 48.

The lower end of the first half of the sector gear 47 is placed in abutment with the abutment pin 55 secured to the lower end of the guide subject plate 50. Each of the securing members 45 and 48 are secured at a predetermined portion of the left side sewing machine frame 56.

The abutting member 53 is rotatably supported by the securing member 48. The abutting member 53 includes a shaft 53*a* secured to the second link member 52 by a screw 57; a first abutting portion 53b abutting the abutment pillar 42 of the transmitting member 37; and a second abutting portion 53*c* abutting the stopper 54. A second torsion spring 59 secured on a screw 58 having one end screwed to the securing member 48 is fitted on the right end of the shaft 53*a*. The abutting member 53 is subject to consistent bias in the direction indicated by arrow C shown in FIG. 3 except when releasing the needle bar 10 at the uppermost position and the second abutting portion 53*c* is in abutment with the stopper 54.

When the needle bar 10 is released at the upper most position by the needle bar release mechanism 31, the guide subject plate 50 is moved downward by driving the drive motor 46 and rotating the sector gear 47 in the direction indicated by arrow D in FIG. 3. The movement of the guide subject plate 50 downwardly moves the lower end of the first link member 51 which movement causes the second link member 52 to rotate about the shaft 53*a* in the opposite direction of the arrow C along with the abutting member 53.

Such rotation of the abutting member 53 exerts pressure on the abutment pillar 42 of the transmitting member 37 in abutment with the first abutting portion 53*b*. Thus, the transmitting member 37 is rotated in the direction indicated by arrow A in FIG. 6 (refer to the abutment pillar 42 indicated by double-dot chain line indicated in FIG. 6) until the abutment pillar 42 abuts the stopper 39. This rotation cancels the engagement between the first and the second engagement members 40 and 41 and the connection pin 18*a*, causing the needle bar 10 to jump up to the uppermost position by the biasing force of the compression coil spring 19. When the needle bar 10 has been released, vertical drive force of the needle bar drive mechanism 30 is not transmitted to the needle bar 10.

On the other hand, in order to switch the needle bar 10 from the released state to the state allowing transmission of drive force of the needle bar drive mechanism 30, first, the transmitting member 37 is driven upwards by the sewing machine motor 110 and the connection pin 18*a* is abutted to the sloped portion 40*a* from above. Thus, the transmitting member 37 is rotated in the direction of the arrow A indicated in FIG. 6.

As a result, the transmitting member 37 is raised and the connecting pin 18*a* is positioned between the first and the second engagement members 40 and 41. Thus, the transmitting member 37 is rotated in the arrow B direction (refer to FIG. 6) by the biasing force of the of the torsion spring 38, and the connecting pin 18a is engaged with the first and the second engagement members 40 and 41, thereby connecting the needle bar 10 vertically movably.

Next, a description will be given on the thread drawing mechanism 32.

The thread drawing mechanism 32 wipes a needle thread end 28A extending downward through the eye 15*a* of the sewing needle 15 upon completion of a sewing operation or needle replacement; and the thread drawing mechanism 32 is also driven upon execution of a needle threading operation; more specifically, when the needle thread 28 caught by a hook portion 62*b* of a needle threading hook 83 which has been passed through the eye 15*a* of the sewing needle 15 is passed through the eye 15*a*.

As shown in FIGS. 3, 5 and 6, the thread drawing mechanism 32 includes a drive motor 46 commonly used for driving the needle bar release mechanism 31 also; a sector gear 47 having a detection subject 60 formed thereto; and an original point detector 61 for detecting the original point position of the detection subject 60. Also, the thread drawing mechanism 32 includes a thread drawing member 62; a connection plate 63 having both ends thereof connected swingably to the thread drawing member 62 and the sector gear 47; a guide member 64 that guides the thread drawing member 62; and lid 65 of the guide member 64.

The thread drawing member 62 includes a standing portion 62a connected swingably to the connection plate 63 and a hook portion 62*b* in a hooked-shape for drawing the needle thread 28. The thread drawing member 62 is clamped between the guide member 64 and the lid member 65 and is supported slidably by a guide groove 64*a* defined in the guide member 64. The original point detector 61 is composed of a photo-interpreter provided with a light receiving element and a light emitting element and when the lower-end edge of the detection subject 60 passes between the light receiving element and the light emitting element, the thread drawing member 62 detects the original point position (stand-by position).

The guide groove 64*a* that guides the thread drawing member 62 is formed so that the thread drawing member 62 is allowed to move further reward from the stand-by position shown in FIGS. 4 and 6 when the drive motor 46 is rotated in the direction of arrow D to drive the needle bar release mechanism 31.

When executing a thread wiping operation, the sector gear 47 is rotated in arrow E direction shown in FIG. 3 by driving the drive motor 46 in the predetermined rotational direction. Since the rotation causes the forward movement of the connecting plate 63, the thread drawing member 62 connected to the lower end of the connection plate 63 passes between the first thread retaining member 14 with guidance of the guide groove 64*a* and moves forward by a predetermined stroke.

At this time, since the hook portion 62*b* of the thread drawing member 62 moves to the thread wiping position below the sewing needle 15, the hook portion 62*b* is engaged with the needle thread 28 downstream relative to the eye 15*a*. Under such state, when the drive motor 46 is driven in reverse rotation, the thread drawing member 62 returns to the stand-by position via the sector gear 47 and the connecting plate 63. At this time, the needle thread-end 28A engaged with the hook portion 62*b* of the thread drawing member 62 is wiped above the workpiece cloth and retained by the thread retaining tape 14*a* of the first thread retaining member 14.

Next, a description will be given on the needle threading mechanism 33.

As shown in FIGS. 4 and 5, the needle threading mechanism 33 includes a needle threading motor 70 composed of a pulse motor; a rack 71; an extension spring 76; a guide frame 77; a crank plate 78; a link block 80 in a rectangular solid form; a pair of left and right threading members 81 and 82; a needle threading hook 83; and a position detector 111 (refer to FIG. 12).

The rack 71 is in mesh engagement with a drive gear 70*a* secured to the output shaft of the needle threading motor 70. Guide pins 72*a* and 72*b* secured to the right side sewing machine frame 73 is engaged with the guide groove 71*a* formed in the rack 71. The extension spring 76 has one end thereof connected to a connection pin 74 secured to the lower end of the rack 71 and the other end connected to the connecting protrusion 75 secured to the guide frame 77, thereby upwardly biasing the rack 71.

The guide frame 77 is secured to the right side sewing machine frame 73 and has a guide groove 77*a* defined thereto. The crank plate 78 is positioned in the right side of the guide frame 77 and is connected to the lower end of the rack 71 via a connection pin 74. The link block 80 is connected swingably to the left side of the guide frame 77 via a first guide subject pin 79 engaged with a guide groove 77*a* at the lower end of the crank plate 78.

A pair of left and right thread hooking members 81 and 82 include sloped portions 81*a* and 82*a* that are secured to the distal end of the link block 80 and that guide the needle thread 28 to the needle threading hook 83. The needle threading hook 83 is clamped between the pair of threading members 81 and 82 and has a hook portion 83*a* to which the needle thread 28 is-threaded. The position detector 111 detects the threading position of the needle threading hook 83.

A second guide subject pin 84 in engagement with the guide groove is 77*a* is secured to the mid-portion of the link block 80. The guide groove 77*a* comprises a sloped portion 77*b* and a horizontal portion 77*c* communicating with the sloped portion 77*b*. Thus, when threading the needle, the guide groove 77*a* initially guides the link block 80 downwardly forward and thereafter horizontally forward.

Referring to FIGS. 3 and 4, check springs 8 are provided at a vertical mid-portion of the needle bar case 5 so as to be associated with each needle bar 10. The check spring 8 as generally known has a thread engaging portion 8*a* in curved form for engagement with the needle thread and is elastically biased counterclockwise as shown in FIG. 4 by a torsion spring not shown.

That is, the check spring 8 assumes a spring force inoperable position in the lower side as indicated by double-dot chain line in FIG. 4 when the needle thread 28 is not engaged with the thread engaging portion 8*a* of the check spring 8; whereas when the needle thread 28 is engaged with the thread engaging portion 8*a* of the check spring 8, the check spring 8 is switched to a spring force operable position in the upper side indicated by solid line in FIG. 4. Thus, in case the engagement portion 8a of the check spring 8 is switched to the spring force operable position, tension exerted by the spring force of the torsion spring is operated on the needle thread 28.

A description will now be given on a threading route of the needle thread 28. The needle thread 28 drawn from the thread spool first threads a thread tension regulator not shown and thereafter threads the thread engaging portion 8*a* of the check spring 8. Then, the needle thread 28 threads the thread take-up 11 and as described earlier, passes the rear side of the guide portion 16*c* from the right side to the left side. Subsequently, the needle thread 28 is pulled forwardly downward and cut by the blade 16*a*, whereafter the needle thread 28 end is retained by the retaining portion 16*b*. At this time, since the needle thread 28 is retained by the retaining portion 16*b* while being drawn from the thread spool by the user, the thread engaging portion 8*a* of the check spring 8 is switched to the spring force operating position.

Figure 7:
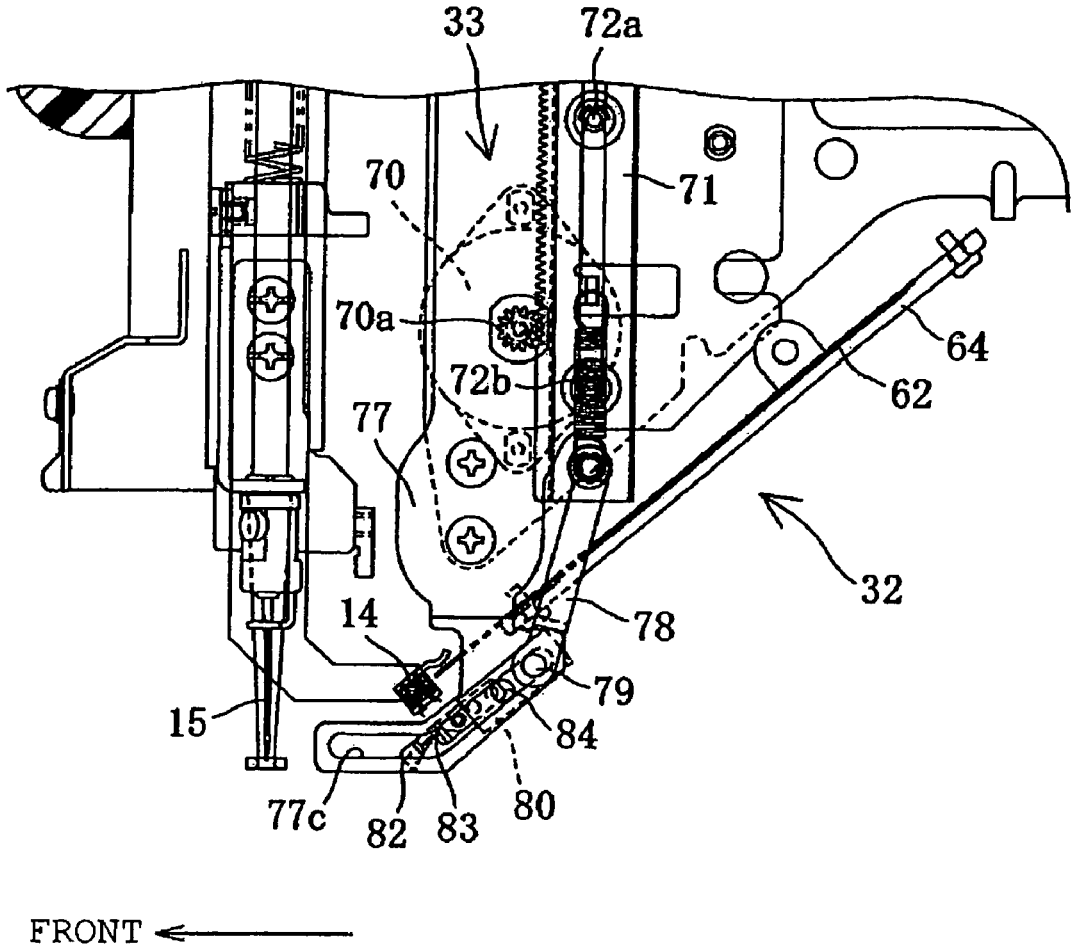
FIG. 7 is a partial right side view of FIG.4 for explaining movement of the thread drawing member.
Figure 9:
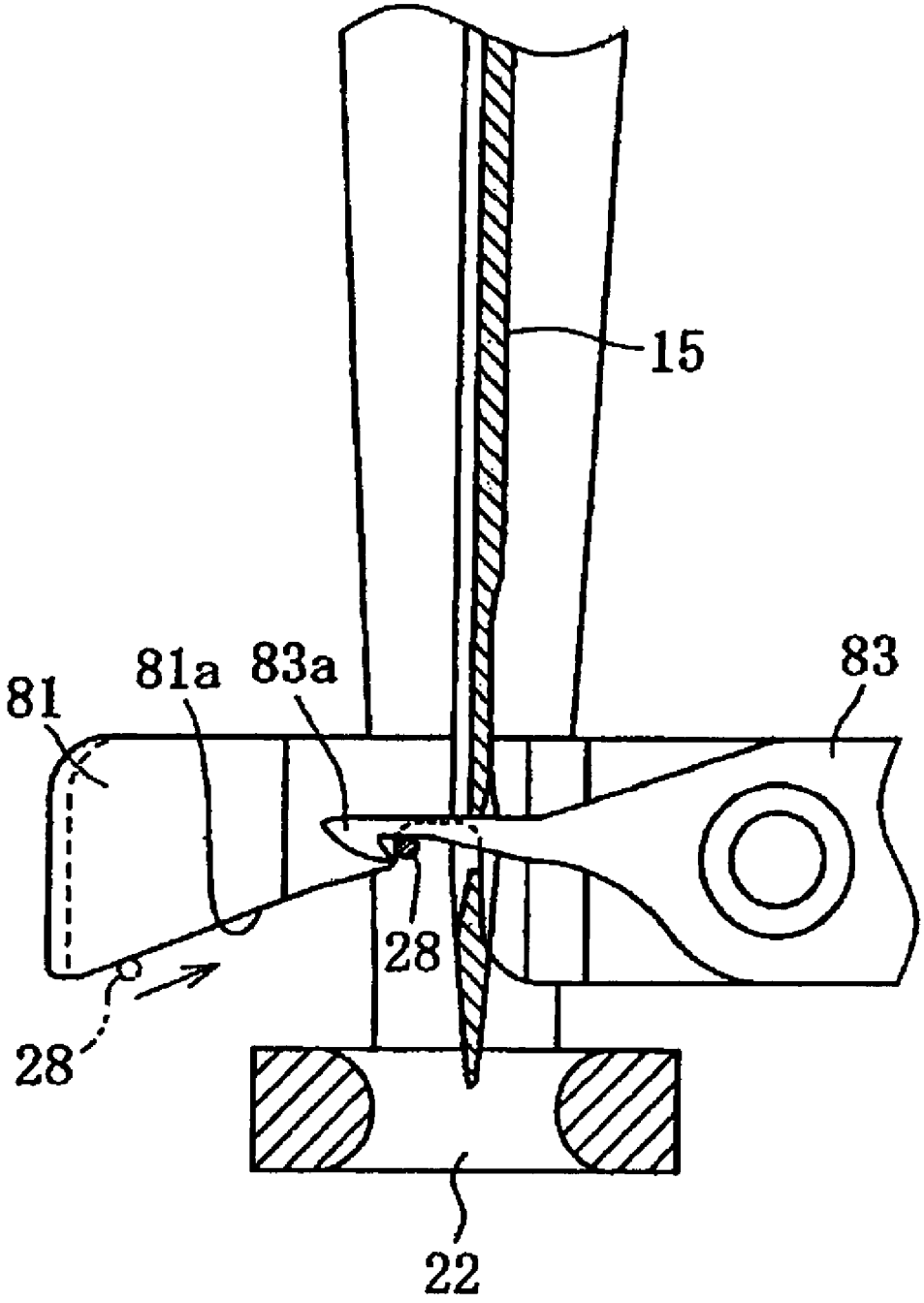
FIG. 9 is a vertical cross-sectional view showing a main portion of a periphery of a sewing needle eye in a threaded state.

Next, a description will be given on a needle threading operation carried out by the thread drawing mechanism 32 and the needle threading mechanism 33. The needle threading hook 83 and the thread drawing member 62 indicated in FIG. 7 are initially positioned in the stand-by position respectively and when the needle threading motor 70 is driven, the rack 71 is moved downward with guidance of guide pins 72*a* and 72*b*. Thus, the rack 71 connected with the crank plate 78 and the link block 80 connected with the crank plate 78 are moved downwardly forward along the sloped portion 77*b* of the guide groove 77*a* in the initial stage of movement and thereafter moved horizontally forward along the horizontal portion 77*c*. Referring to FIGS. 4 and 9, the link block 80 is moved until the hook portion 83*a* of the needle threading hook 83 is passed through the eye 15*a* of the sewing needle 15 and is stopped at a threading position where the second guide subject pin 84 is placed in abutment with the front end portion of the guide groove 77*a*.

Figure 10:
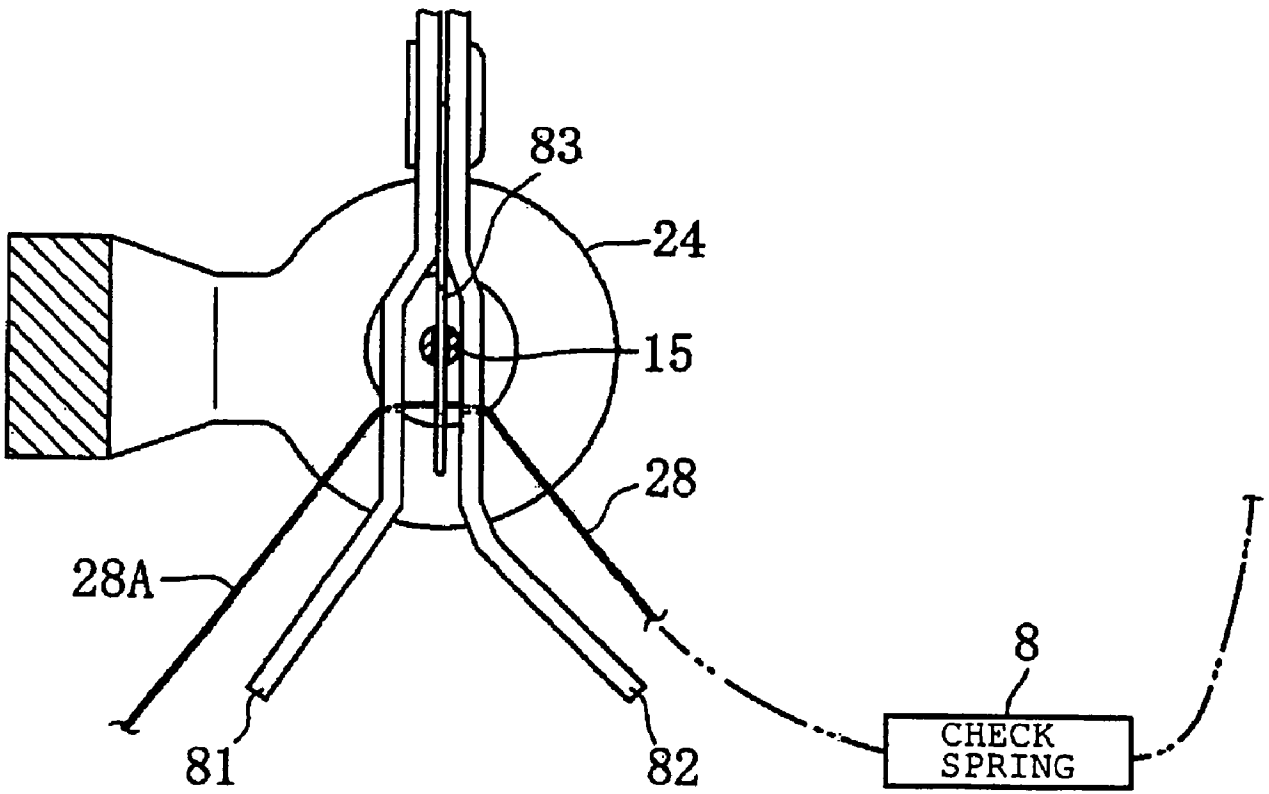
FIG. 10 is a transverse plan view showing the main portion of the periphery of the sewing needle eye in the threaded state.

Next, referring to FIGS. 2 and 4, the user is to thread the needle thread 28 guided by thread guides 85 and 86, and the like, to the threading members 81 and 82 from the right side and cut the needle thread 28 by the blade 16*a* of the second needle retaining member 16. Then, the needle thread 28 end is retained by being clamped between retaining portion 16*b* and the front face of the needle bar case 5. At this point, as shown in FIGS. 9 and 10, by the user's upward pull of the needle thread 28 threaded on the threading members 81 and 82, the needle thread 28 is moved to the needle threading hook 83 with guidance of the sloped portions 81*a* and 82*a* of the threading members 81 and 82 and thereafter ultimately is hooked on the hook portion 83*a*.

Figure 8:
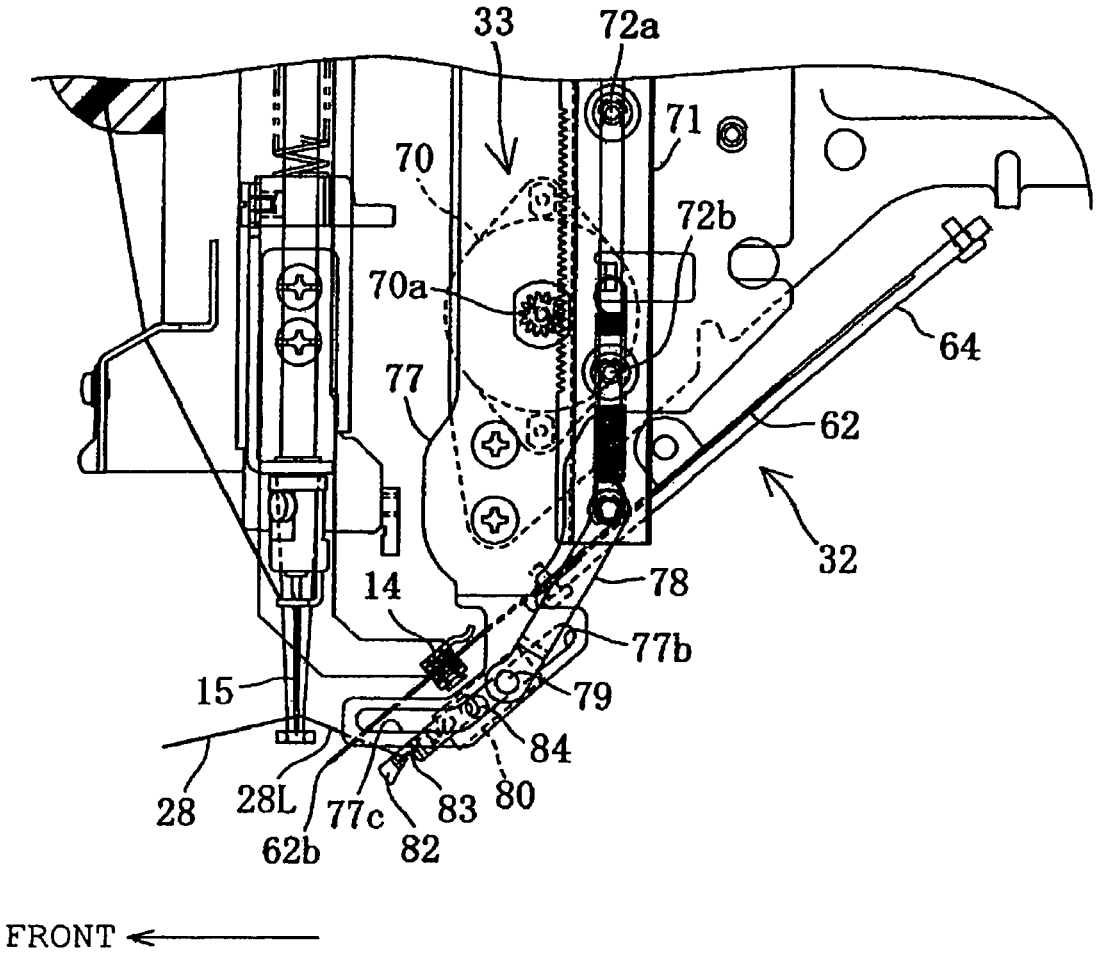
FIG. 8 corresponds to FIG. 7 for explaining movement of the thread drawing member.

Next, the needle threading hook 83 is stopped at a loop cancel position located behind the sewing needle 15, spaced rearward by a predetermined distance, by the drive of the needle threading motor 70. Subsequently, as shown in FIG. 8, the hook portion 62*b* of the thread drawing member 62 is passed through a needle thread loop 28L and is moved in the same locus as the thread wiping operation until reaching an engaging position below the needle thread loop 28L by the drive of the drive motor 46 to be engaged with a thread-end loop thread 28F (refer to FIG. 11) of the needle thread loop 28L. The engaging position is located slightly above the thread wiping position and requires less moving distance as compared with the thread wiping operation.

Figure 11:
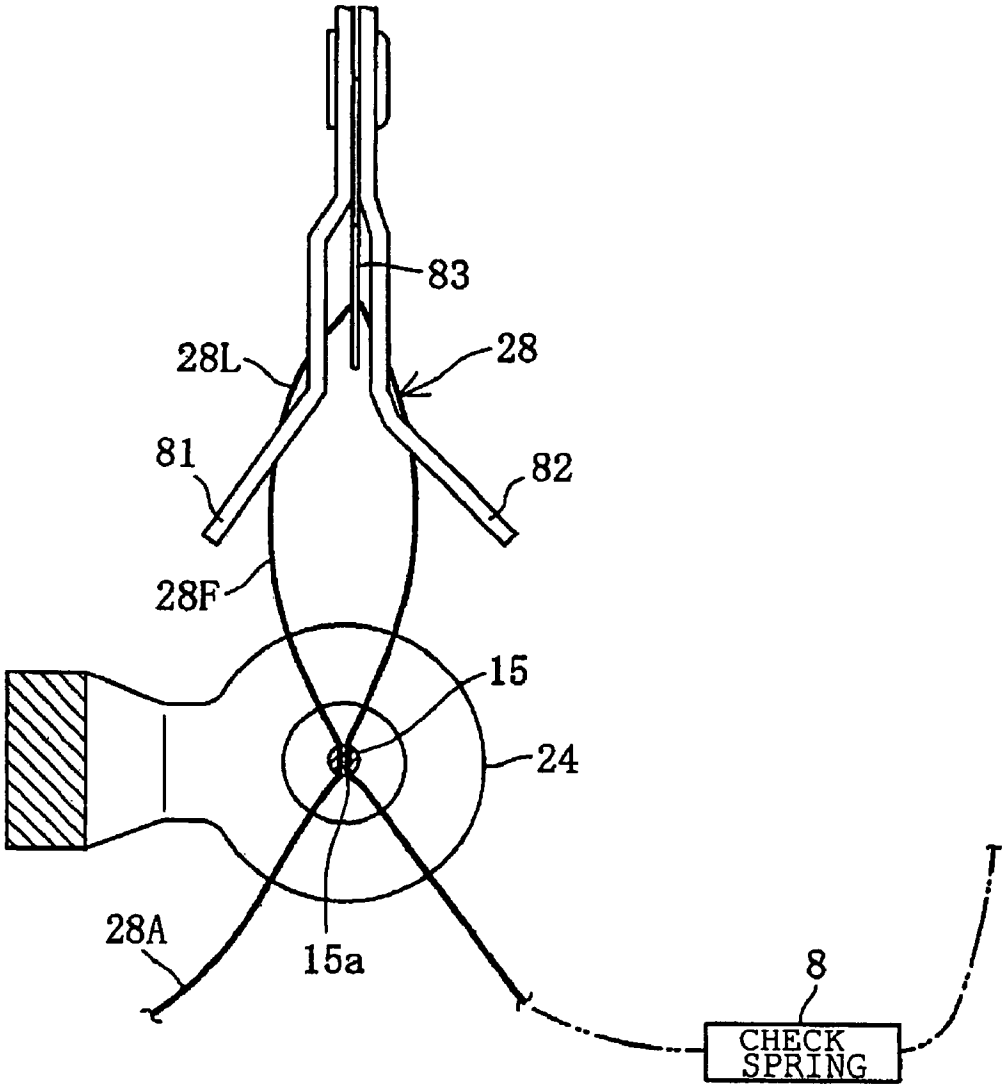
FIG. 11 is a transverse plan view showing the main portion of the periphery of the sewing needle eye having a thread loop formed thereto.

At this point, the needle thread 28 end is removed from the second thread retaining member 16, whereby the tension of the needle thread 28 is loosened and the needle thread loop 28L is engaged with the needle threading hook 83. Thus, as shown in FIG. 11, the lateral width of the needle thread loop 28L between the needle threading hook 83 and the eye 15*a* is increased without drooping downward. Further, as shown in FIG. 8, since the hook portion 83*a* of the needle threading hook 83 is positioned below the eye 15*a* of the sewing needle 15, the needle thread loop 28L becomes substantially perpendicular to the thread drawing member 62 and the thread drawing member 62 reliably passes through the needle thread loop 28L to be engaged with the needle thread 28.

Next, when the thread drawing member 62 is returned to the stand-by position by the drive of the drive motor 46, the thread-end loop thread 28F of the needle thread loop 28L is pulled out of the eye 15*a* and removed from the needle threading hook 83 to cancel the needle thread loop 28L. Furthermore, since the thread drawing member 62 moves passed the first thread retaining member 14 while drawing the thread-end loop thread 28L of the needle thread 28, the needle thread 28 is retained by the first thread retaining member 14 of the thread retaining tape 14*a*. Thus, the needle thread 28 is passed through the eye 15*a*. Next, the needle threading hook 83 is returned to the stand-by position by the drive of the needle threading motor 70 to complete the needle threading operation.

An operation panel 9 is provided with an operating portion 91 including a laterally elongate liquid crystal display 90 and a needle threading switch 92 (refer to FIG. 12). The needle threading switch 92 is a switch for instructing automatic needle threading operation by operating the needle threading mechanism 33.

Next, a description will be given on control unit 100 that controls the multi-needle embroidery sewing machine M based on the block diagram of FIG. 12.

The control unit 100 is configured by a computer including a CPU 102, a ROM 103, a RAM 104, an input-output interface 106, and a bus 105 connecting the foregoing. The input-output interface 106 receives input of detection signals delivered from an original point detector 61 detecting an original point position of the thread drawing member 62, a detection signal delivered from the position detector 111 detecting the position of the needle threading hook 83, and switch signals delivered from the operating portion 91 of the operation panel 9 respectively.

The input-output interface 106 outputs drive signals for a drive circuit 107 for the liquid crystal display 90 and the sewing machine motor 110; a drive circuit 108 for the drive motor 46; a drive circuit 109 for the needle threading motor 70; and a drive circuit 113 for a needle bar changing motor 112 respectively.

The RAM 103 stores a sewing control program that executes sewing process by controlling the sewing machine motor 110, the drive motor 46, the needle threading motor 70 and the needle bar changing motor 112; a control program for a later described needle threading control constituting the feature of the present disclosure, and the like. The RAM 104 includes various memory and buffer required for sewing control. The sewing machine motor 110 is composed of a DC servo motor capable of feed back control and exhibits outstanding positioning accuracy in controlling rotational position of the sewing machine motor 110.

Figure 13A:
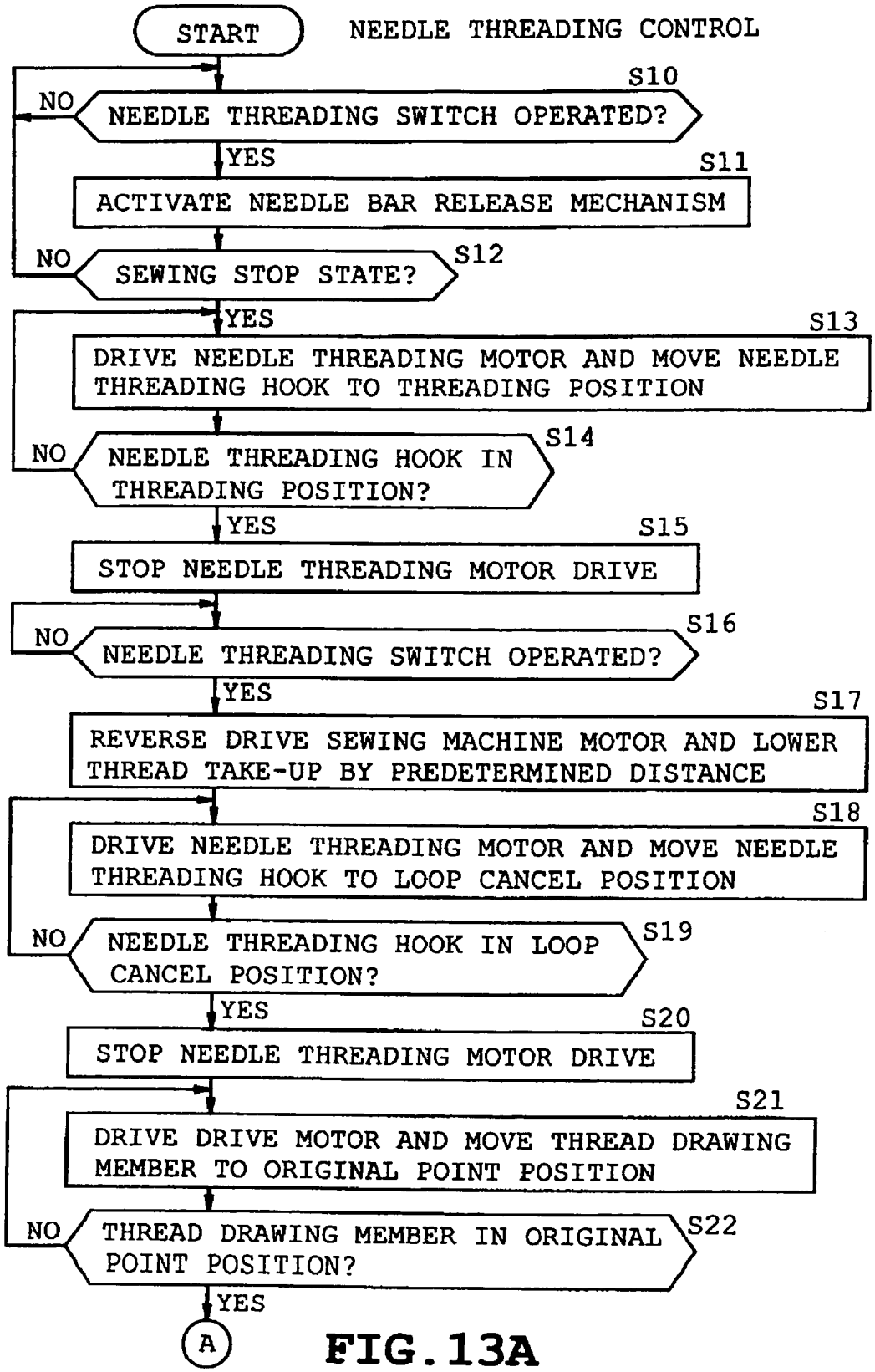
FIG. 13 is a flowchart of a needle threading control.
Figure 13B:
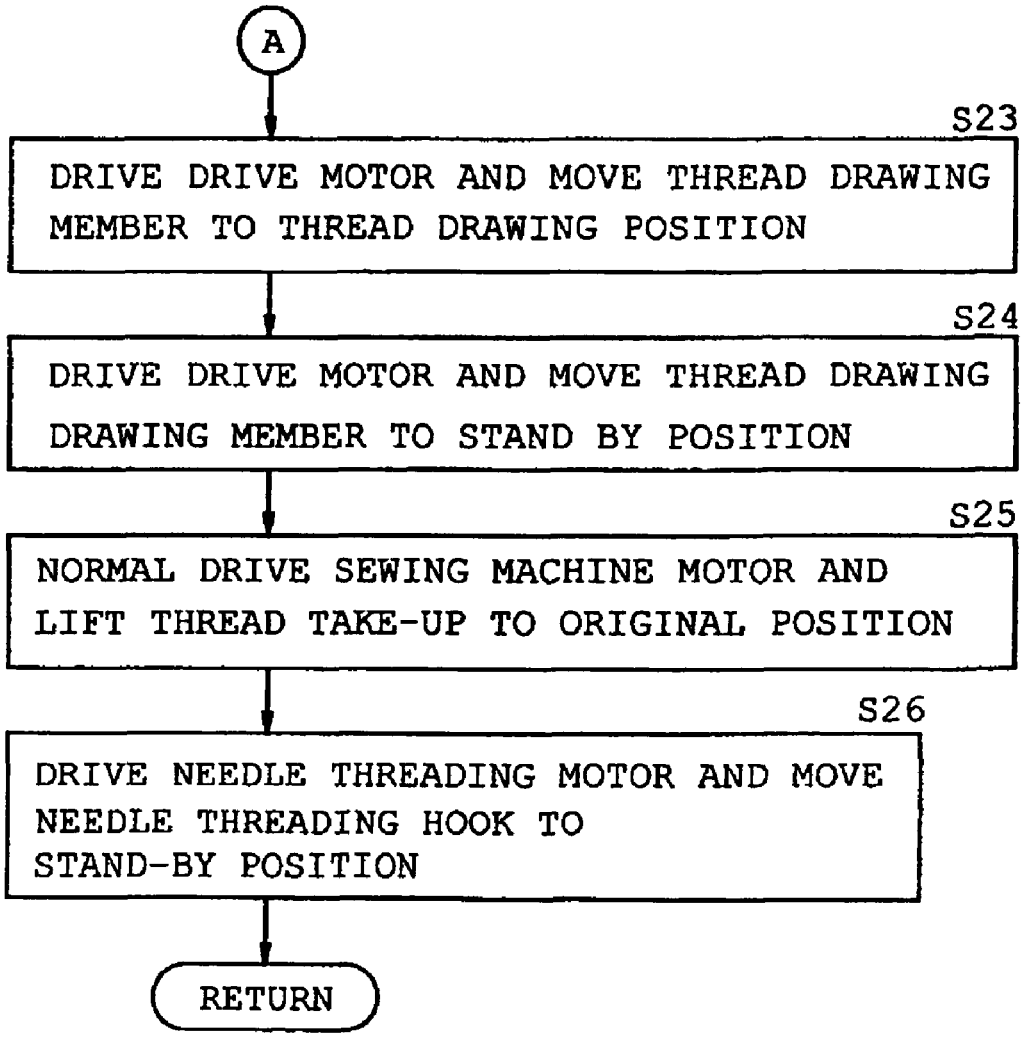

Next, the needle threading control executed by the control unit 100 will be described based on the flowchart in FIG. 13. The reference symbol Si (i=10, 11, 12 . . . ) indicated each step.

When the needle threading switch 92 of the operation panel 9 is operated by the user (S10: Yes), the drive motor 46 is driven to activate the needle bar release mechanism 31 (S11) to block the drive of the needle bar 10. Next, in case the sewing machine motor 110 is not driven and the sewing operation is in a stopped state (S12: Yes), the needle threading motor 70 is driven by one or several steps and the needle threading hook 83 is moved slightly toward the threading position (S13). Then, when no detection signal is outputted from the position detector 111 (S14: No), S13 to S14 are repeated.

Thereafter, in case a detection signal is outputted from the position detector 111 and the needle threading hook 83 is moved to the threading position (S14: Yes), the drive of the needle threading motor 70 is stopped (S15). At this point, the hook portion 83*a* of the needle threading hook 83 has been passed through the eye 15*a* of the sewing needle 15. Then, the user draws the needle thread 28 from the thread spool and as described earlier, threads the thread tension regulator, the check spring 8, the thread-take up 11, and the threading members 81 and 82 along the threading route and cuts needle thread 28 passed behind the guide portion 16*c* by the blade 16*a*. The needle thread 28 end is thereafter retained by the retaining portion 16*b*.

At this time, since the needle thread 28 is retained by the retaining portion 16*b* with tension operated on the needle thread, thus, the thread engaging portion 8*a* of the check spring 8 is switched to the spring force operable position. Moreover the needle thread 28 is engaged with the hook portion 83*a* to allow execution of needle threading operation.

Next, when the needle threading switch 92 is operated again (S16: Yes), the sewing machine motor 110 is driven in reverse rotation and the thread take-up 11 is lowered (indicated by double-dot chain line in FIG. 4) by a predetermined distance (14 mm for example) (S17). At this time, the spring force of the check spring 8 absorbs the loss of the required thread amount at the thread take-up 11 caused by the lowering of the thread take-up 11 and the thread engaging portion 8*a* is switched to the spring force inoperable position. Thus, the rest of the needle threading process from thereafter is carried out without any thread tension on the needle thread 28 and needle thread 28 is prevented from being drawn toward the check spring 8.

Subsequently, the needle threading motor 70 is driven by one or several steps based on the needle threading instruction issued from the needle threading switch 92 and the needle threading hook 83 is retracted toward the loop cancel position (S18). When no detection signal is outputted from the position detector 111 (S19: No), s18 to s19 are repeated.

Then, when the detection signal is outputted from the position detector 111 and when the needle threading hook 83 is retracted to the loop cancel position (S19: Yes), the drive of the needle threading motor 70 is stopped (S20). Thus, upon retracting the needle threading hook 83 to the loop cancel position, the needle threading hook 83 comes out of the eye 15*a* of the sewing needle 15 with the needle thread-end 28A engaged with the hook portion 83*a* of the needle threading hook 83.

In this case, the thread engaging portion 8*a* of the check spring 8 is switched to the spring force inoperable position before the needle thread-end 28A is pulled out of the second thread retaining member 16. Thus, the spring force of the check spring 8 does not affect the needle thread-end 28A, and stabilize the behavior of the needle thread-end 28A so that it does not come off of the hook portion 83*a*.

Next, the drive motor 46 is driven by one or several steps and the thread drawing member 62 is moved slightly toward the original point position (S21) by rotating the sector gear 47 in the arrow E direction. If no detection signal is outputted from the original point detector 61 (S22: No), S21 to S22 are repeated.

When detection signal is outputted from the original point detector 61 and the thread drawing member 62 is moved to the original point position (S22: Yes), the drive motor 46 is driven by a predetermined number of steps and the thread drawing member 62 is moved forward to the engaging position (S23). At this time, as described earlier, the thread-end loop thread 28F of the needle thread loop 28L is engaged with the hook portion 62*b* of the thread drawing member 62.

Next, the drive motor 46 is driven in reverse direction by a predetermined number of steps and the thread drawing member 62 having the needle thread loop 28L engaged therewith is returned to the stand-by position to cancel the needle thread loop 28L. Thus, the needle thread 28 is passed through the eye 15*a* and the needle thread 28 end is retained by the thread retaining tape 14*a* of the first thread retaining member 14 (S24).

Subsequently, the sewing machine motor 110 is driven in normal rotation and the thread take-up 11 is raised by a predetermined distance (14 mm for example), in other words, raised to the original position (S25). At this time, the thread amount required at the thread take-up 11 for vertical movement of the thread take-up 11 is supplied from the needle thread end 28A side, the needle thread end 28A being retained by the first thread retaining member 14. Thereafter, the needle threading motor 70 is driven and the needle threading hook 83 is ultimately returned to the stand-by position (S26).

The multi-needle embroidery sewing machine M of the present embodiment in accordance with the above described configuration includes a thread take-up 11, a needle bar 10, a check spring 8, a needle threading mechanism 33, a needle threading motor 70, a sewing machine motor 110, and a control unit 100 that controls the drive of the sewing machine motor 110. When threading the eye 15*a* of the sewing needle 15 by driving the needle threading mechanism 33 by the needle threading motor 70, the control unit 100 controls the drive of the sewing machine motor 110 so as to lower the thread take-up 11 by a predetermined distance in order that spring force of the check spring 8 is not operated on the needle thread 28. Thus, when the needle threading hook 83 passes through the eye 15*a* and comes out of the eye 15*a* after engaging the needle thread 28 therewith, no thread tension is operated on the needle thread 28 even in case needle thread end is pulled off of the first thread retaining portion 14. Thus, the needle thread 28 being placed in a stable condition does not come off of the needle threading hook 83, thereby reliably preventing needle threading errors.

Also, in the above describe embodiment, the distance of lowering the thread take-up 11 has been specified to be equivalent to the distance in which the thread engaging portion 8*a*, engaging with the needle thread 28 provided to the check spring 8, moves from the spring force operable position to the spring force inoperable position. Thus, the thread engagement portion 8*a* of the check spring 8 is reliably moved from the spring force operable position to the spring force inoperable position, thereby allowing reliable cancellation of thread tension operated on the needle thread 28.

Also, in the above described embodiment, the needle thread amount supplied by the lowering of the thread take-up 11 by predetermined distance (14 mm for example) is specified to be equivalent to the thread amount required to switch the thread engaging portion 8*a*, engaging with the needle thread 28 provided to the check spring 8, from the spring force operable position to the spring force inoperable position, thereby reliably moving the thread engagement portion 8*a* of the check spring 8 from the spring force operable position to the spring force inoperable position. Thus, the thread tension operated on the needle thread 28 can be reliably cancelled.

Also, the above described embodiment includes a needle bar release mechanism 31 for intermitting the drive force of the needle bar drive mechanism 30 that drives the needle bar 10. When threading the eye 15*a* of the sewing needle 15 by driving the needle threading mechanism 33 by the needle threading motor 70, the control unit 100 drives the needle bar release mechanism 31 so as to block the drive of the needle bar 10 by the needle bar release mechanism 31. Thus, even if the thread take-up 11 is lowered by predetermined distance upon execution of needle threading operation, the needle bar 10 is retained at a position capable of threading the needle without being lowered and the eye 15*a* of the sewing needle 15 can be reliably threaded by the needle threading hook 83 while securing user safety.

Further, since the present embodiment employs a servo motor capable of feed back control for the sewing machine motor 110, the thread take-up 11 can be driven to be lowered only by the predetermined distance with high accuracy and speed.

A description will be given on the partial modifications of the present embodiment.

(1) The distance of lowering the thread engaging portion 8*a* of the check spring 8 from the spring force operable position to the spring force inoperable position is specified at a predetermined distance in consideration of the material of the needle thread 28, the spring constant of the check spring 8, the thread amount at the thread take-up 11 and the thread amount at the rotating shuttle not shown. Thus, in S16 of the needle threading control, the sewing machine motor 110 maybe controlled so that the lowering distance of the thread take-up 11 by driving the sewing machine motor 110 in reverse rotation may be equal to or greater than the distance of movement of thread engaging portion 8*a* of the check spring 8 used. Also, the user may be allowed to specify the lowering distance to any value.

(2) The thread amount required to switch the thread engaging portion 8*a* of the check spring 8 from the spring force operable position to the spring force inoperable position is specified at a predetermined needle thread amount in consideration of the material of the needle thread 28, the spring constant of the check spring 8, the amount of thread at the thread take-up 11 and the thread amount at the rotating shuttle not shown. Thus, in S16 of the needle threading control, the sewing machine motor 110 may be controlled so that the thread amount supplied by the lowering of the thread take-up 11 by driving the sewing machine motor 110 in reverse rotation may be equal to or greater than the amount of needle thread required to switch the thread engaging portion 8*a* of the check spring 8 used from the spring force operable position to the spring force inoperable position.

(3) The sewing machine motor 110 is not limited to a DC servo motor but may employ various servo motors capable of executing feed back control such as an AC servo motor and a pulse motor provided with encoder unit capable of outputting rotational phase angle signals.

(4) The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

What is claimed is:

1. A sewing machine, comprising:

a thread take-up;

a needle bar to which a sewing needle is attached;

a check spring provided in a threading route of a needle thread and engaging with the needle thread directed toward the thread take-up;

a needle threading mechanism that has a needle threading hook for threading an eye of the sewing needle;

a needle threading mechanism drive unit that drives the needle threading mechanism;

a sewing machine motor that drives the thread take-up and the needle bar;

a control unit that controls the sewing machine motor; and the control unit controls the sewing machine motor to lower the thread take-up only by a predetermined distance so that a spring force of the check spring is not operated on the needle thread when threading the eye of the sewing needle by driving the needle threading mechanism by the needle threading mechanism drive unit.

2. The sewing machine of claim 1, wherein the predetermined distance of lowering the thread take-up is equal to or greater than a distance of movement of a thread engaging portion that engages with the needle thread provided to the check spring from a spring force operable position to a spring force inoperable position.

3. The sewing machine of claim 1, wherein a thread amount supplied by the lowering of the thread take-up by the predetermined distance is equal to or greater than a thread amount required to switch a thread engaging portion that engages with the needle thread provided to the check spring from a spring force operable position to a spring force inoperable position.

4. The sewing machine of claim 1, further comprising a needle bar release mechanism that intermits a drive force of a needle bar drive mechanism that drives the needle bar, wherein the control unit controls the needle bar release mechanism to block the drive of the needle bar by the needle bar release mechanism when threading the eye of the sewing needle by driving the needle threading mechanism by the needle threading mechanism drive unit.

5. The sewing machine of claim 1, wherein the sewing machine motor is composed of a servo motor.

* * * * *